US012578120B2

(12) United States Patent
Choi

(10) Patent No.: US 12,578,120 B2
(45) Date of Patent: Mar. 17, 2026

(54) BOILER FOR MAKING HOT WATER AND ROOM HEATING WATER AVAILABLE SIMULTANEOUSLY

(71) Applicant: Sung-Hwan Choi, Seoul (KR)

(72) Inventor: Sung-Hwan Choi, Seoul (KR)

( * ) Notice: Subject to any disclaimer, the term of this patent is extended or adjusted under 35 U.S.C. 154(b) by 461 days.

(21) Appl. No.: 17/634,814

(22) PCT Filed: Apr. 27, 2021

(86) PCT No.: PCT/KR2021/005294
§ 371 (c)(1),
(2) Date: Feb. 11, 2022

(87) PCT Pub. No.: WO2022/215794
PCT Pub. Date: Oct. 13, 2022

(65) Prior Publication Data

US 2023/0358440 A1 Nov. 9, 2023

(30) Foreign Application Priority Data

Apr. 6, 2021 (KR) ..... 10-2021-0044545

(51) Int. Cl.
*F24H 1/44* (2022.01)
*F24D 3/08* (2006.01)
(Continued)

(52) U.S. Cl.
CPC ..... *F24H 1/44* (2013.01); *F24D 3/08* (2013.01); *F24D 3/087* (2013.01); *F24H 1/16* (2013.01);
(Continued)

(58) Field of Classification Search
None
See application file for complete search history.

(56) References Cited

U.S. PATENT DOCUMENTS 5,791,299 A 8/1998 Matsuo et al.

FOREIGN PATENT DOCUMENTS

CN 103328905 A 9/2013
CN 108195059 A 6/2018
(Continued)

OTHER PUBLICATIONS

KR-20040098305-A English translation (Year: 2004).*
(Continued)

*Primary Examiner* — Michael G Hoang
*Assistant Examiner* — Kurt J Wolford
(74) *Attorney, Agent, or Firm* — Studebaker Brackett PLLC

(57) ABSTRACT

The present disclosure relates to a boiler for making hot water and room heating water available simultaneously, which is capable of enabling a user to use hot water and room heating simultaneously. According to the present disclosure, a thermal loss of room heating water may be minimized because the room heating water is independently supplied to a room heating pipe and returned regardless of the use of hot water, and the hot water with a high temperature may be consistently supplied because the hot water is independently supplied to a hot water pipe and returned regardless of the use of the room heating water. In addition, the boiler may serve as both a hot-water heat exchanger and a distributor (low loss header).

4 Claims, 8 Drawing Sheets

(51) Int. Cl.

| | |
|---|---|
| ***F24H 1/16*** | (2022.01) |
| ***F24H 1/18*** | (2022.01) |
| ***F24H 1/43*** | (2022.01) |
| ***F24H 1/52*** | (2022.01) |
| ***F28D 7/02*** | (2006.01) |
| ***F28D 20/00*** | (2006.01) |

(52) U.S. Cl.

CPC ..... *F24H 1/165* (2013.01); *F24H 1/18* (2013.01); *F24H 1/186* (2013.01); *F24H 1/43* (2013.01); *F24H 1/52* (2013.01); *F28D 7/024* (2013.01); *F28D 2020/0078* (2013.01)

(56) References Cited

FOREIGN PATENT DOCUMENTS

| | | | | |
|---|---|---|---|---|
| JP | S61195241 | A | * | 8/1986 |
| JP | H0523844 | U | * | 3/1993 |
| KR | 20-1996-0003886 | Y1 | | 5/1996 |
| KR | 200238364 | Y1 | * | 9/2001 |
| KR | 10-2004-0098305 | A | | 11/2004 |
| KR | 20040098305 | A | * | 11/2004 |
| KR | 10-2010-0099956 | A | | 9/2010 |
| KR | 10-2012-0089171 | A | | 8/2012 |
| KR | 20120089171 | A | * | 8/2012 |
| KR | 10-2013-0004771 | A | | 1/2013 |

OTHER PUBLICATIONS

Nevercold (Year: 2020).*
JP H0523844 U English translation (Year: 1993).*
KR-200238364-Y1 English translation (Year: 2001).*
KR-20120089171-A English translation (Year: 2012).*
JP S61195241 A translation (Year: 1986).*
An Office Action; mailed by the China National Intellectual Property Administration of the People's Republic of China on Feb. 17, 2025, which corresponds to Chinese Patent Application No. 202180054709.8 and is related to U.S. Appl. No. 17/634,814.

* cited by examiner

BOILER FOR MAKING HOT WATER AND ROOM HEATING WATER AVAILABLE SIMULTANEOUSLY

CROSS-REFERENCE TO RELATED APPLICATIONS

This application is the U.S. National Stage of International Application No. PCT/KR2021/005294 filed Apr. 27, 2021, which claims benefit of priority to Korean Patent Application No. 10-2021-0044545 filed Apr. 6, 2021, the entire content of which is incorporated herein by reference.

TECHNICAL FIELD

The present disclosure relates to a boiler for making hot water and room heating water available simultaneously, and more particularly, to a boiler for making hot water and room heating water available simultaneously, which is capable of enabling a user to use hot water and room heating simultaneously.

BACKGROUND ART

In general, a gas boiler is used to heat a room by using gas as fuel and using water as a heating medium. A hot-water boiler is a combustor that also makes hot water available by circulating room heating circulating water in the boiler through a three-way valve and heating water by means of indirect heat exchange. The gas boilers are installed in various buildings such as homes, offices, or factories and supply hot water or room heating water. The gas boilers may be classified into a general boiler and a condensing boiler depending on whether condensate water is produced. The gas boilers may be classified into an instantaneous boiler and a hot-water storage boiler depending on the method of supplying hot water.

A basic structure of the gas boiler includes a combustion device and a heat exchanger provided in a housing. The combustion device provides a space in which fuel, i.e., gas is combusted in the form of free flame having an appropriate length. The combustion device is structured such that a combustion gas discharged from the combustion device exchanges heat with a heating medium in a heat exchanger and then is discharged through a flue.

FIG. 1 is a view schematically illustrating a condensing gas boiler in the related art. Referring to FIG. 1, the condensing gas boiler in the related art includes a sensible heat exchange part 2 disposed above a combustion part 1 including a burner 1*a* and configured to be heated by the burner 1*a*, and a latent heat exchange part 3 disposed above the sensible heat exchange part 2 and configured to be heated by an exhaust gas having passed through the sensible heat exchange part 2. Further, hot water of the sensible heat exchange part 2 and cold water supplied through a direct water pipe 4 exchange heat by a hot-water heat exchanger 5. A three-way valve 7 is provided between the hot-water heat exchanger 5 and the sensible heat exchange part 2 and selectively supplies hot water, which is discharged from the sensible heat exchange part 2, to the hot-water heat exchanger 5 or a room heating water supply pipe 6. In addition, a circulation pump 9 is provided between the latent heat exchange part 3 and a water tank 8. The water tank 8 is connected to a room heating water returning pipe 10. The room heating water returning pipe 10 is connected to the hot-water heat exchanger 5 and allows the hot water, which has exchanged heat with the cold water, to return to the water tank 8. Further, the water, which returns after heating a room, is introduced into the latent heat exchange part 3 by an operation of the circulation pump 9. The room heating water introduced into the latent heat exchange part 3 is preheated by exchanging heat with the exhaust gas having passed through the sensible heat exchange part 2. The preheated room heating water is introduced into the sensible heat exchange part 2 again and heated directly by the burner 1*a*. The heated hot water is transmitted to the hot-water heat exchanger 5 or the room heating water supply pipe 6 by an operation of the three-way valve 7 and heats the room or exchanges heat with the cold water supplied through the direct water pipe 4.

Because the related art is configured such that the three-way valve 7 is used to transmit the hot water to the hot-water heat exchanger 5 or the room heating water supply pipe 6, the hot-water heat exchanger cannot perform its function while transmitting the hot water to the room heating water supply pipe 6. For this reason, there is a problem in that a temperature of the hot water decreases.

DISCLOSURE

Technical Problem

The present disclosure has been made in an effort to solve the problem in the related art, and an object of the present disclosure is to provide a boiler in which a hot water connection pipe and a room heating water connection pipe are separately provided to make hot water and room heating water available simultaneously and additionally serve as both a hot-water heat exchanger and a distributor (low loss header).

Technical Solution

To achieve the object, the present disclosure provides a boiler for making hot water and room heating water available simultaneously, the boiler including: a heat exchanger; a water tank positioned at one side of the heat exchanger and having a vacant space therein; a casing configured to cover the heat exchanger and the water tank; a first connection pipe configured to connect an upper side of the heat exchanger and an upper side of the water tank; a second connection pipe configured to connect a lower side of the heat exchanger and a lower side of the water tank; a coil pipe positioned in the water tank; a room heating water connection pipe configured to connect the water tank and an inlet of a room heating pipe; a returning water connection pipe configured to connect an outlet of the room heating pipe and the water tank; a direct water connection pipe configured to connect a direct water pipe and one end of the coil pipe; and a hot water connection pipe configured to connect the other end of the coil pipe and a hot water pipe.

In addition, one side of the room heating water connection pipe may be connected to the upper side of the water tank, the other side of the room heating water connection pipe may be connected to the inlet of the room heating pipe, one side of the returning water connection pipe may be connected to the outlet of the room heating pipe, the other side of the returning water connection pipe may be connected to the lower side of the water tank, one side of the direct water connection pipe may be connected to the direct water pipe, the other side of the direct water connection pipe may penetrate the upper side of the water tank and be connected to one end of the coil pipe, one side of the hot water connection pipe may be connected to one end of the coil pipe, and the other side of the hot water connection pipe may penetrate the water tank and be connected to an inlet of the hot water pipe.

In addition, the coil pipe may include: a first coil tube provided in a coil shape in a longitudinal direction of an inner peripheral edge of the water tank; a second coil tube provided in a coil shape inside the first coil tube and positioned in a direction opposite to the inner peripheral edge of the water tank; and a connection tube configured to connect a lower side of the first coil tube and a lower side of the second coil tube, the direct water connection pipe may be connected to the first coil tube, and the hot water connection pipe may be connected to the second coil tube.

In addition, the boiler may further include a hot returning water connection pipe having one side connected to an outlet of the hot water pipe and the other side connected to the direct water pipe.

In addition, the boiler may further include an air vent pipe protruding upward from the upper side of the water tank; and an on-off valve provided at an upper end of the air vent pipe and configured to open or close the air vent pipe, the room heating water connection pipe may be connected to one side of the air vent pipe and supply the room heating pipe with the room heating water supplied from the water tank.

In addition, the casing may integrally cover the heat exchanger, the water tank, the first connection pipe, and the second connection pipe.

Advantageous Effects

According to the present disclosure, the room heating water is independently supplied to the room heating pipe and returned regardless of the use of hot water. Therefore, it is possible to minimize a thermal loss of the room heating water. In addition, since the hot water is independently supplied to the hot water pipe and returned regardless of the use of the room heating water, the hot water with a high temperature may be consistently supplied, and the boiler may serve as both a hot-water heat exchanger and a distributor (low loss header).

In addition, since the high-temperature room heating water, which has exchanged heat in the heat exchanger, is supplied to the room heating water connection pipe, the room heating water may be always and consistently maintained at a high temperature.

In addition, the direct water, which moves along the direct water connection pipe, moves along the first coil tube and the second coil tube for a long period of time and remains in the water tank for a long period of time. Therefore, it is possible to improve heat exchange efficiency between the direct water and the room heating water accommodated in the water tank.

In addition, since the second coil tube is positioned inside the first coil tube, the heat of the second coil tube is relatively less discharged to the outside, such that a temperature of the second coil tube is kept higher than a temperature of the first coil tube. Therefore, the hot water, which is supplied to the second coil tube through the first coil tube, becomes hot water with a higher temperature while passing through the second coil tube.

In addition, one side of the hot returning water connection pipe is connected to the outlet of the hot water pipe, and the other side of the hot returning water connection pipe is connected to a lateral portion of the direct water pipe, thereby increasing a temperature of the direct water moving from the direct water pipe to the first coil tube.

In addition, since the casing integrally covers the heat exchanger and the water tank, a product has a compact, clean external appearance. In addition, since the first connection pipe and the second connection pipe are positioned in the casing, the first connection pipe and the second connection pipe are not affected by a change in outside temperature, such that a thermal loss does not occur in respect to the first connection pipe and the second connection pipe.

DESCRIPTION OF MAIN REFERENCE NUMERALS OF DRAWINGS

Figure 1:
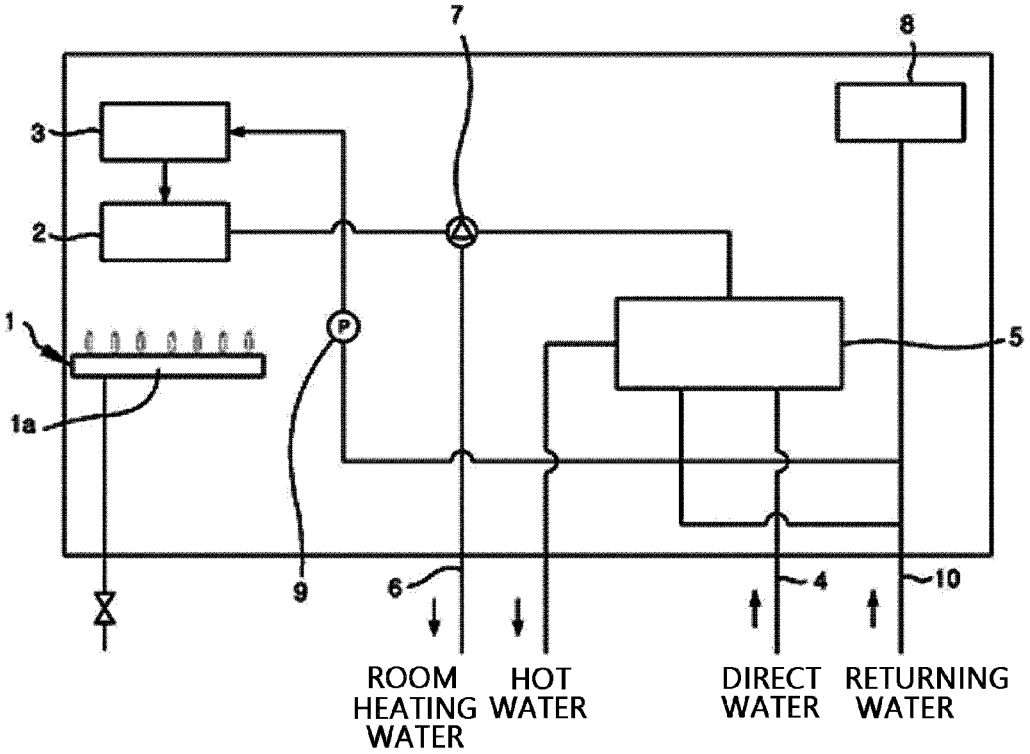
FIG. 1 is a view schematically illustrating a condensing gas boiler in the related art.

100: Boiler
110: Casing
120: Heat exchanger
130: Water tank
140: First connection pipe
150: Second connection pipe
152: Circulation pump
160: Coil pipe
162: First coil tube
164: Second coil tube
170: Air vent pipe
180: Room heating water connection pipe
182: Returning water connection pipe
190: Direct water connection pipe
192: Hot water connection pipe
194: Hot returning water connection pipe

MODE FOR INVENTION

Hereinafter, a boiler for making hot water and room heating water available simultaneously according to an exemplary embodiment of the present disclosure will be described in more detail with reference to the accompanying drawings.

Figure 2:
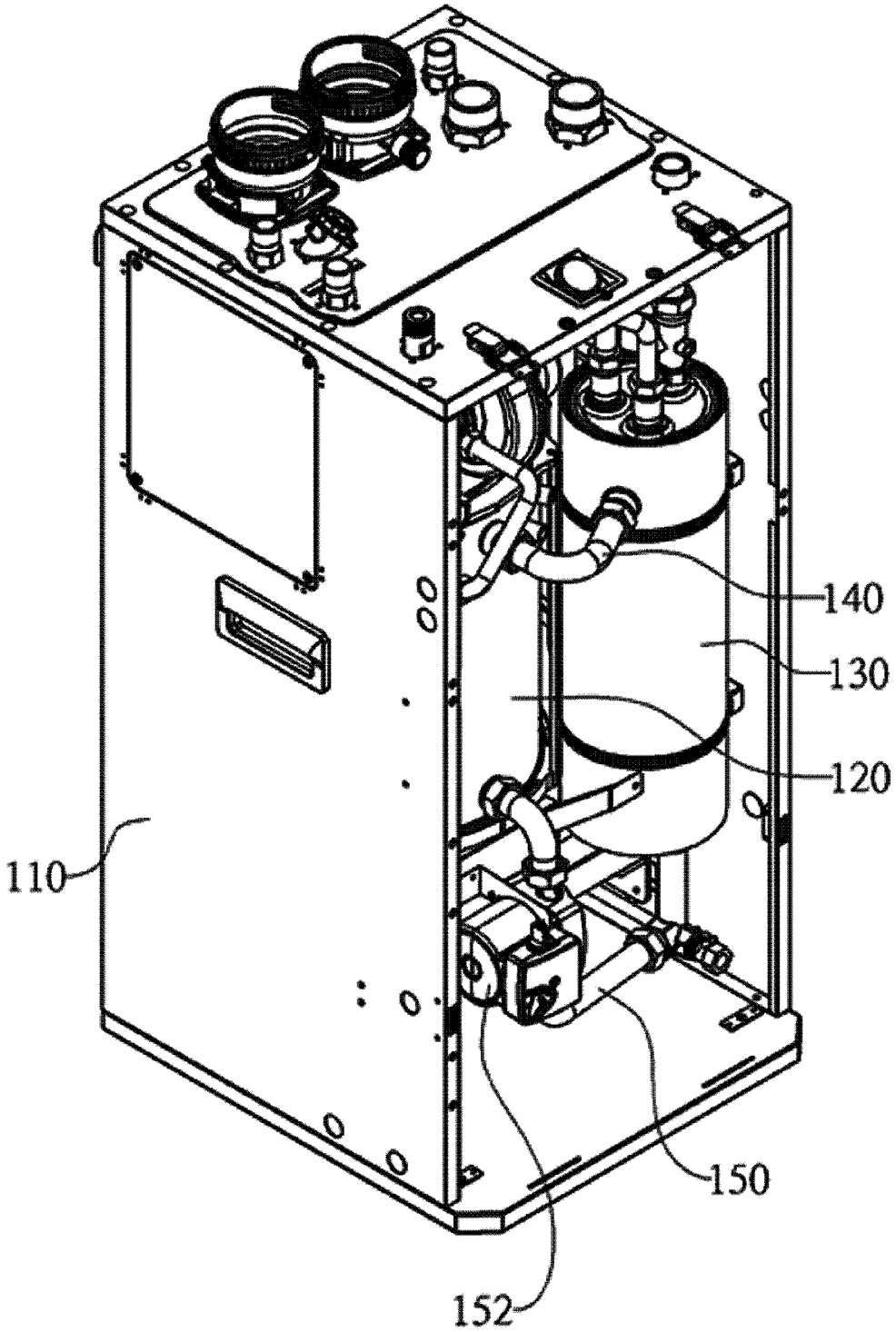
FIG. 2 is a view schematically illustrating a boiler for making hot water and room heating water available simultaneously according to an exemplary embodiment of the present disclosure.
Figure 3:
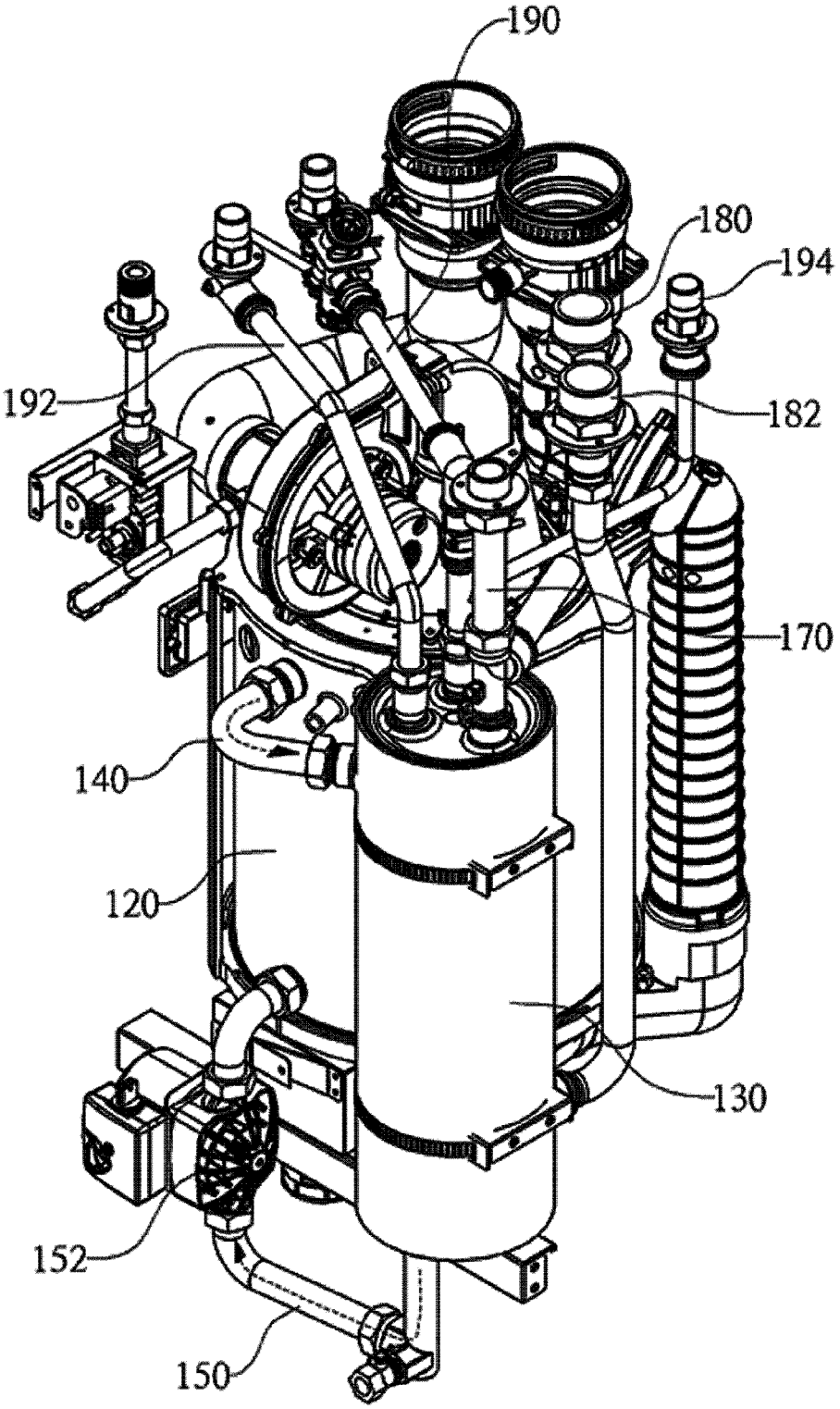
FIG. 3 is a perspective view schematically illustrating a state in which a casing is removed from the boiler for making hot water and room heating water available simultaneously according to the exemplary embodiment of the present disclosure.
Figure 4:
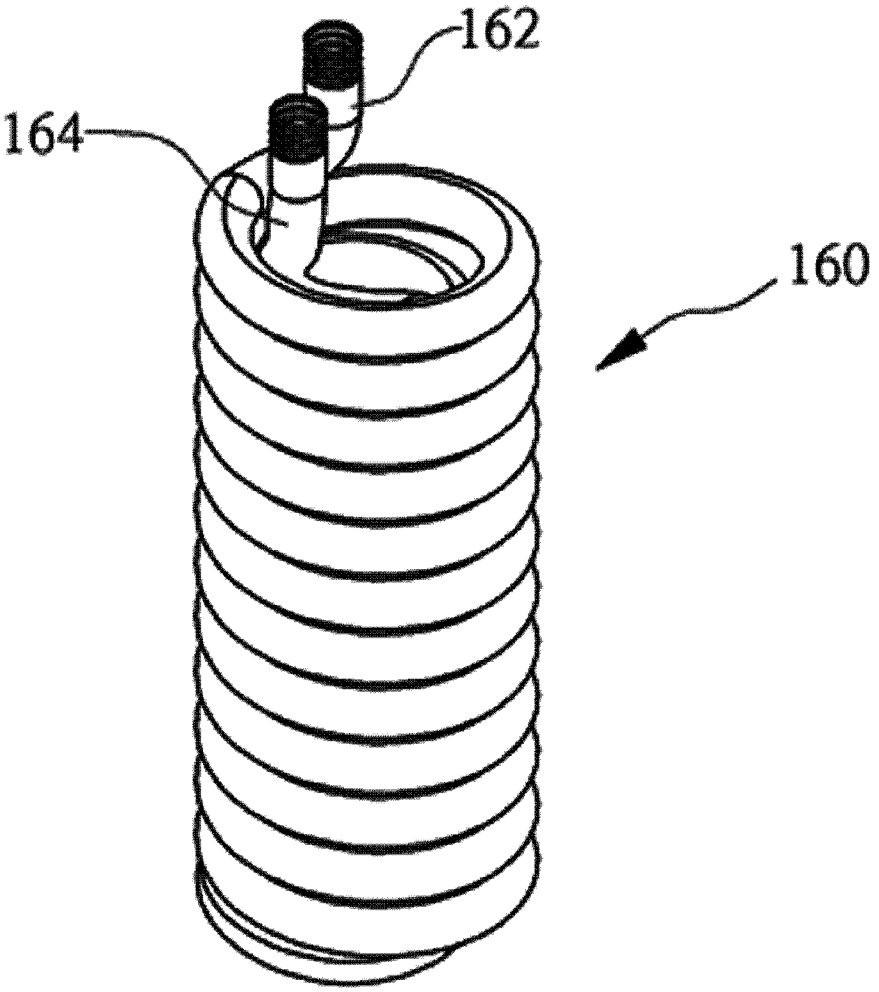
FIG. 4 is a view schematically illustrating a coil pipe of the boiler for making hot water and room heating water available simultaneously according to the exemplary embodiment of the present disclosure.

FIG. 2 is a view schematically illustrating a boiler for making hot water and room heating water available simultaneously according to an exemplary embodiment of the present disclosure, FIG. 3 is a perspective view schematically illustrating a state in which a casing is removed from the boiler for making hot water and room heating water available simultaneously according to the exemplary embodiment of the present disclosure, and FIG. 4 is a view schematically illustrating a coil pipe of the boiler for making hot water and room heating water available simultaneously according to the exemplary embodiment of the present disclosure.

Referring to FIGS. 2 to 4, a boiler 100 for making hot water and room heating water available simultaneously according to an exemplary embodiment of the present disclosure includes a heat exchanger 120, a water tank 130, a coil pipe 160, a first connection pipe 140, a second connection pipe 150, and a casing 110.

The heat exchanger 120 has a typical configuration that allows water to exchange heat with a combustion gas supplied from a combustion device. The heat exchanger 120 may be one of various types of well-known heat exchangers 120. The water tank 130 is positioned at one side of the heat exchanger 120 and may have an approximately cylindrical shape or the like. The water tank 130 defines a vacant space for accommodating the water.

The coil pipe 160 includes: a first coil tube 162 provided in a coil shape in a longitudinal direction of an inner peripheral edge of the water tank 130; a second coil tube 164 provided in a coil shape inside the first coil tube 162 and positioned in a direction opposite to the inner peripheral edge of the water tank 130; and a connection tube (not illustrated) configured to connect a lower side of the first coil tube 162 and a lower side of the second coil tube 164.

The first connection pipe 140 connects an upper side of the heat exchanger 120 and an upper side of the water tank 130. The second connection pipe 150 connects a lower side of the heat exchanger 120 and a lower side of the water tank 130. Further, the water in the heat exchanger 120 produces room heating water by exchanging heat with the combustion gas, and the produced room heating water is supplied to the water tank 130 through the first connection pipe 140. Further, a part of the room heating water supplied into the water tank 130 raises a temperature of the coil pipe 160 positioned in the water tank 130, and the other part of the room heating water supplied into the water tank 130 is supplied to a room heating pipe. For example, the room heating pipe is embedded in a floor in a home or office and configured to raise an indoor temperature.

The casing 110 integrally covers the heat exchanger 120, the water tank 130, the first connection pipe 140, and the second connection pipe 150. Since the casing 110 covers the heat exchanger 120 and the water tank 130, a product has a compact, clean external appearance. In addition, since the first connection pipe 140 and the second connection pipe 150 are positioned in the casing 110, the first connection pipe 140 and the second connection pipe 150 are not affected by a change in outside temperature, such that a thermal loss does not occur in respect to the first connection pipe 140 and the second connection pipe 150.

Figure 5:
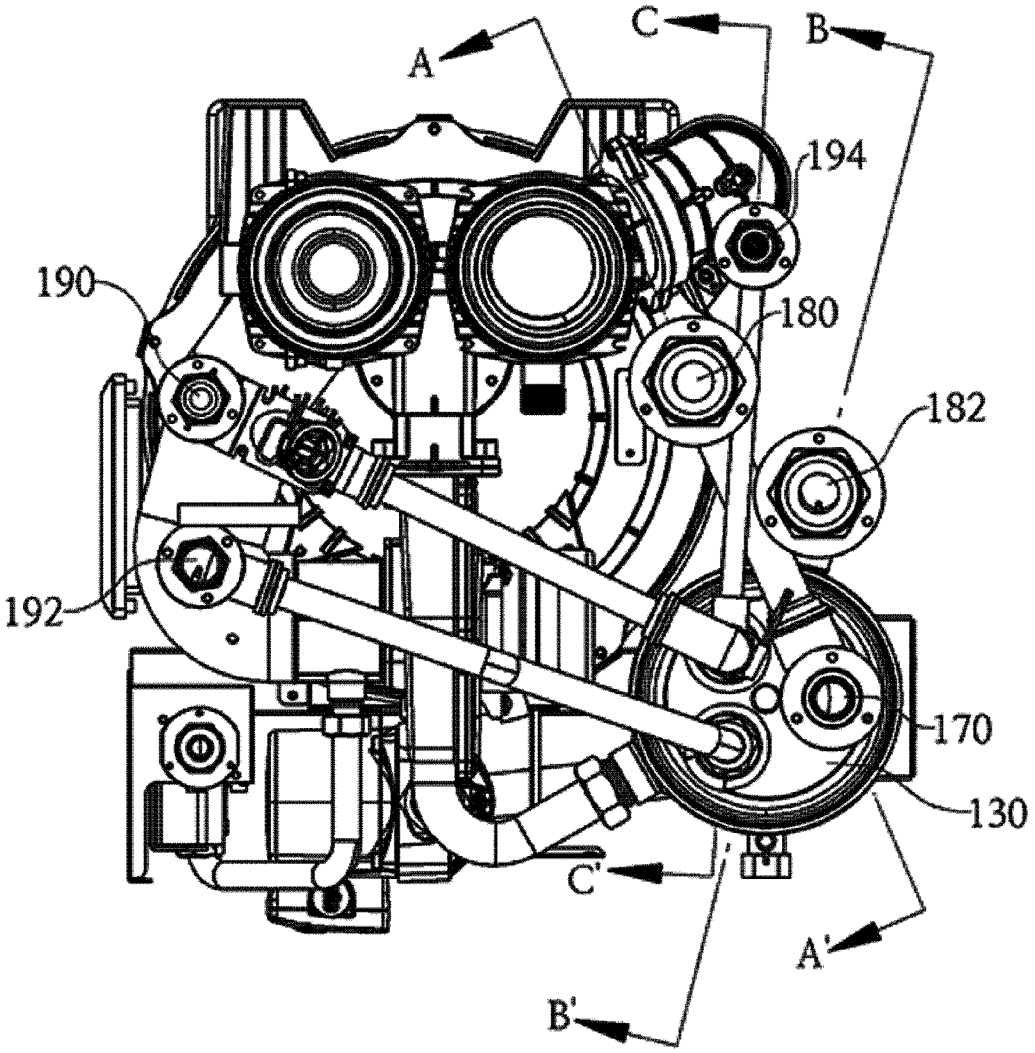
FIG. 5 is a top plan view schematically illustrating a state in which the casing is removed from the boiler for making hot water and room heating water available simultaneously according to the exemplary embodiment of the present disclosure.
Figure 6:
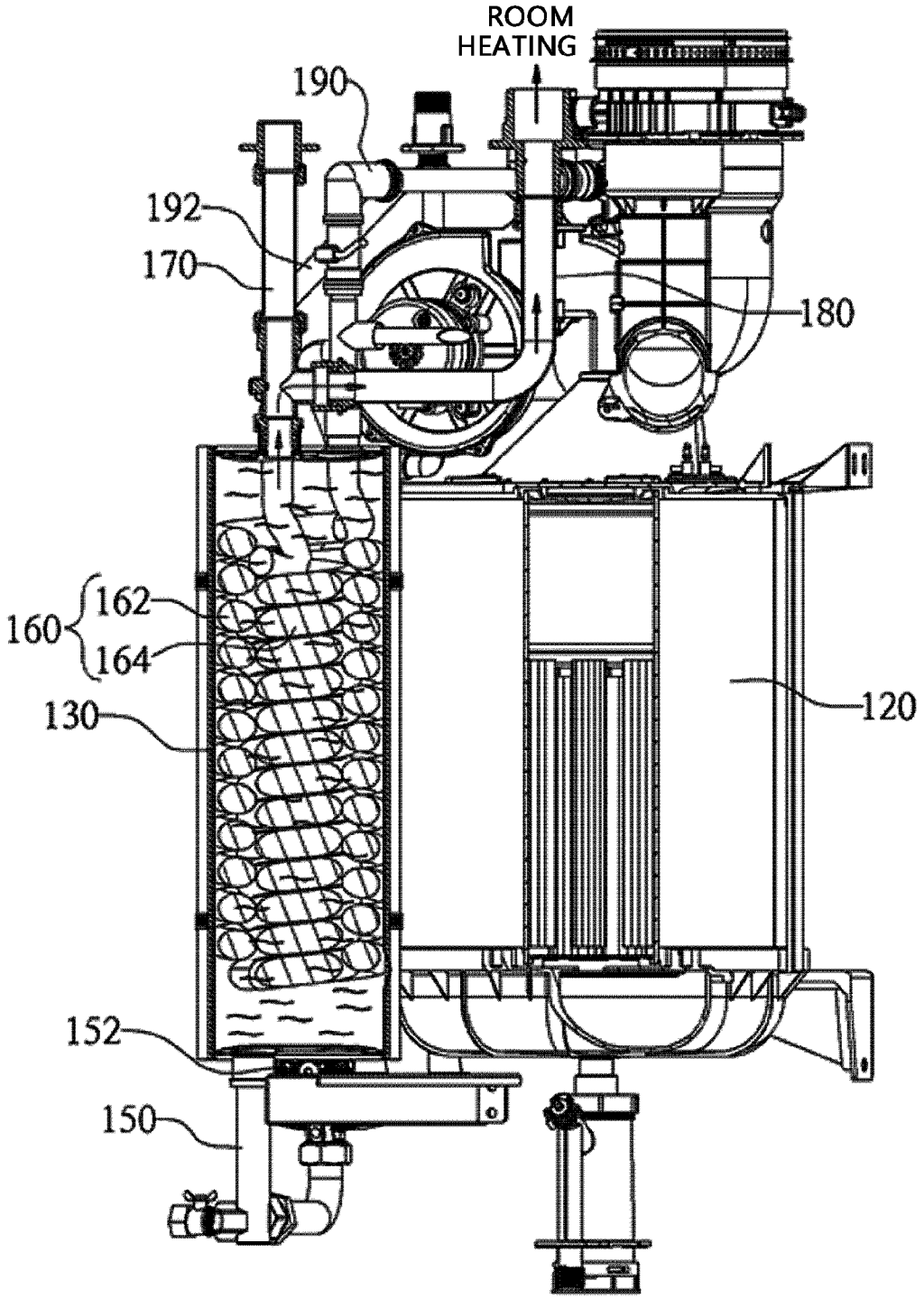
FIG. 6 is a view illustrating a cross-section taken along line A-A' in FIG. 5.
Figure 7:
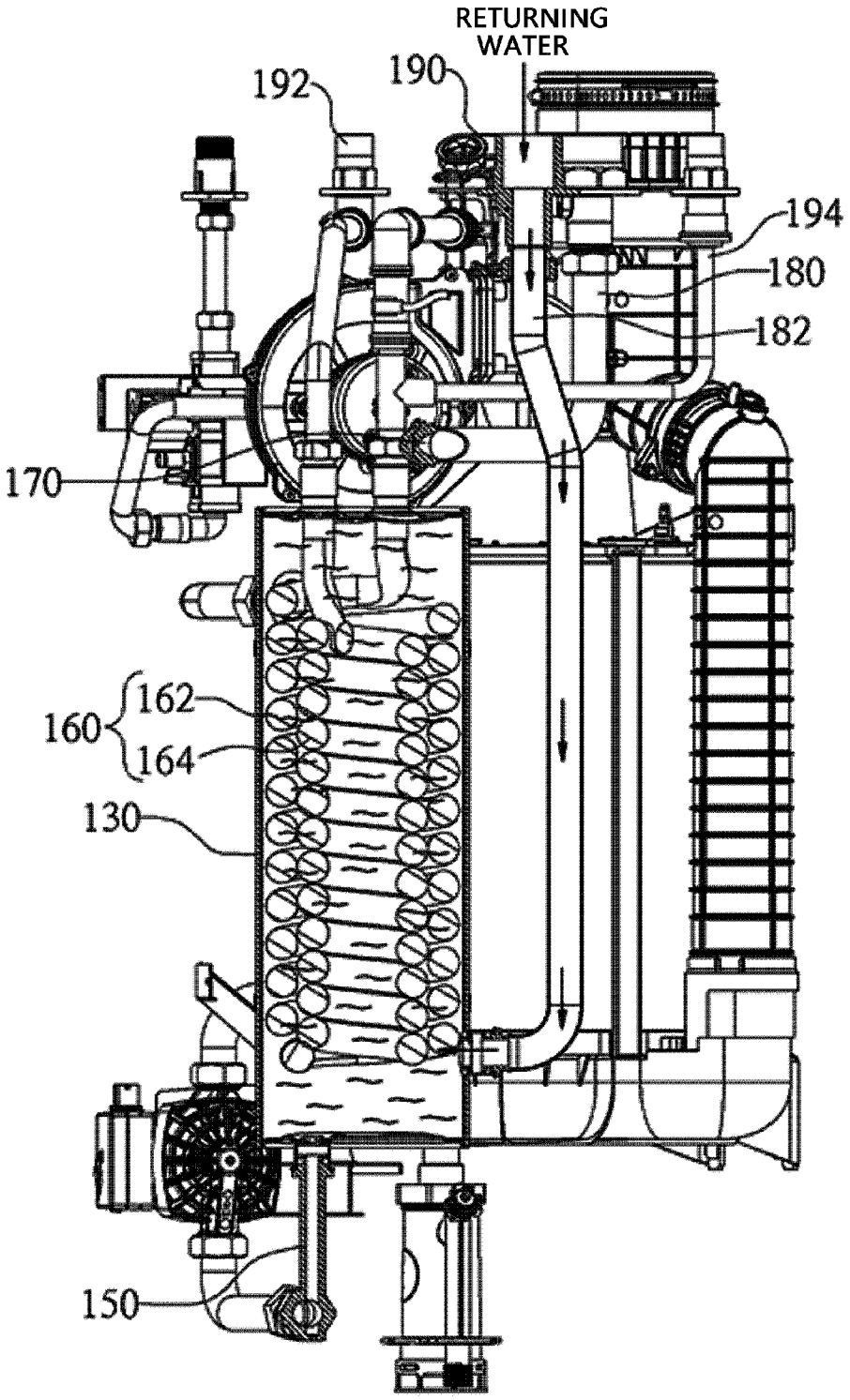
FIG. 7 is a view illustrating a cross-section taken along line B-B' in FIG. 5.

FIG. 5 is a top plan view schematically illustrating a state in which the casing is removed from the boiler for making hot water and room heating water available simultaneously according to the exemplary embodiment of the present disclosure, FIG. 6 is a view illustrating a cross-section taken along line A-A' in FIG. 5, and FIG. 7 is a view illustrating a cross-section taken along line B-B' in FIG. 5.

Referring to FIGS. 2 to 7, the boiler for making hot water and room heating water available simultaneously according to the exemplary embodiment of the present disclosure further includes a room heating water connection pipe 180 configured to connect the water tank 130 and an inlet of the room heating pipe, and a returning water connection pipe 182 configured to connect the water tank 130 and an outlet of the room heating pipe.

One side of the room heating water connection pipe 180 is connected to the upper side of the water tank 130, and the other side of the room heating water connection pipe 180 is connected to the inlet of the room heating pipe. One side of the returning water connection pipe 182 is connected to the outlet of the room heating pipe, and the other side of the returning water connection pipe 182 is connected to the lower side of the water tank 130.

Further, an air vent pipe 170 protrudes upward from the upper side of the water tank, and an on-off valve (not illustrated) is provided at an upper end of the air vent pipe 170 to open or close the air vent pipe 170. In this case, the room heating water connection pipe 180 is connected to one side of the air vent pipe 170 and supplies the room heating pipe with the room heating water supplied from the water tank 130. Further, when a pressure in the water tank 130 caused by moisture vapor exceeds a reference value, the on-off valve is opened, such that the vapor in the water tank 130 may be discharged to the outside through the air vent pipe 170.

Further, the room heating water accommodated in the water tank 130 is discharged to the outside of the water tank 130 through the room heating water connection pipe 180 and then moved to the inlet of the room heating pipe, thereby heating a room by raising a temperature of the room heating pipe. Further, the room heating water, which is moved to the outlet of the room heating pipe through the room heating pipe, returns to the water tank 130 through the returning water connection pipe 182. According to the present disclosure described above, the room heating water is independently supplied to the room heating pipe and returned regardless of the use of hot water. Therefore, it is possible to minimize a thermal loss of the room heating water.

In addition, the room heating water connection pipe 180 is connected to the upper side of the water tank 130, and the returning water connection pipe 182 is connected to the lower side of the water tank 130. This configuration uses the principle that water is raised as the temperature thereof increases, and water is lowered as the temperature thereof decreases. The relatively high-temperature room heating water positioned at the upper side of the water tank 130 is supplied to the room heating pipe through the room heating water connection pipe 180. In this case, since the first connection pipe 140 is also positioned at the upper side of the water tank 130, the high-temperature room heating water, which has exchanged heat in the heat exchanger 120, is supplied to the inner upper side of the water tank 130, and the high-temperature room heating water is supplied to the room heating water connection pipe 180. According to the present disclosure, since the high-temperature room heating water, which has exchanged heat, is supplied to the room heating water connection pipe 180, the room heating water may be always and consistently maintained at a high temperature.

Meanwhile, the relatively low-temperature room heating water, which has passed through the room heating pipe, is guided to the lower side of the water tank 130 through the returning water connection pipe 182 and then introduced into the lower side of the heat exchanger 120 again through the second connection pipe 150 and the circulation pump 152. The circulation pump 152 is mounted at an end of the second connection pipe 150 connected to the heat exchanger 120.

Figure 8:
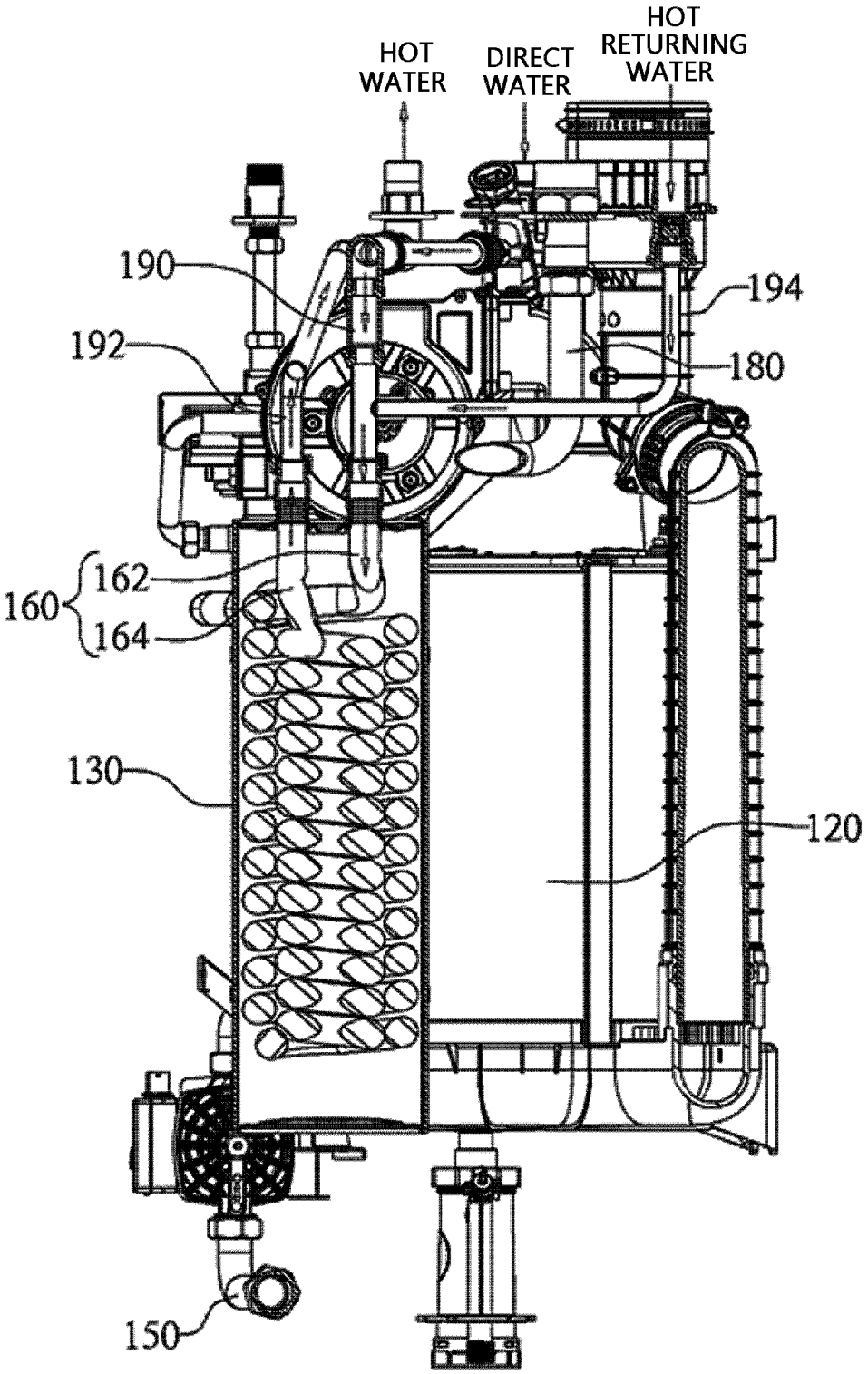
FIG. 8 is a view illustrating a cross-section taken along line C-C' in FIG. 5.

FIG. 8 is a view illustrating a cross-section taken along line C-C' in FIG. 5.

Referring to FIGS. 2 to 8, the boiler for making hot water and room heating water available simultaneously according to the exemplary embodiment of the present disclosure further includes a direct water connection pipe 190 configured to connect the direct water pipe and one end of the coil pipe 160, a hot water connection pipe 192 configured to connect the other end of the coil pipe 160 and a hot water pipe, and a hot returning water connection pipe 194 configured to connect an outlet of the hot water pipe and the direct water pipe.

One side of the direct water connection pipe 190 is connected to the direct water pipe, and the other side of the direct water connection pipe 190 penetrates the upper side of the water tank 130 and is connected to one end of the first coil tube 162. One side of the hot water connection pipe 192 is connected to one end of the second coil tube 164, and the other side of the hot water connection pipe 192 penetrates the water tank 130 and is connected to an inlet of the hot water pipe. Further, the hot water connection pipe 192, the air vent pipe 170, and the direct water connection pipe 190, which penetrates the upper side of the water tank 130, are positioned to be spaced apart from one another without overlapping one another. One side of the hot returning water connection pipe 194 is connected to the outlet of the hot water pipe, and the other side of the hot returning water connection pipe 194 is connected to a lateral portion of the direct water pipe, thereby increasing a temperature of the direct water moving from the direct water pipe to the first coil tube 162.

Further, since the direct water connection pipe 190 is connected to the first coil tube 162, the direct water, which is supplied from the direct water connection pipe 190 to the first coil tube 162, exchanges heat with the room heating water accommodated in the water tank 130 while moving along the first coil tube 162 and the second coil tube 164, thereby producing hot water. In this case, the direct water moves along the first coil tube 162 and the second coil tube 164 for a long period of time and remains in the water tank 130 for a long period of time. Therefore, it is possible to improve heat exchange efficiency between the direct water and the room heating water accommodated in the water tank 130.

In addition, since the second coil tube 164 is positioned inside the first coil tube 162, the heat of the second coil tube 164 is relatively less discharged to the outside, such that a temperature of the second coil tube 164 is kept higher than a temperature of the first coil tube 162. Therefore, the hot water, which is supplied to the second coil tube 164 through the first coil tube 162, becomes hot water with a higher temperature while passing through the second coil tube 164.

Further, the hot water, which is moved along the first coil tube 162 and the second coil tube 164, is supplied to the inlet of the hot water pipe through the hot water connection pipe 192, such that the hot water is supplied to a home or office, for example. Further, when the temperature of the hot water supplied to the hot water pipe decreases to a predetermined temperature or lower, the hot water is returned through the hot returning water connection pipe 194 and supplied to the direct water connection pipe 190 again. As described above, according to the present disclosure, the hot water is independently supplied to the hot water pipe and returned regardless of the use of the room heating water. Therefore, it is possible to consistently supply the hot water with a high temperature.

While the present disclosure has been described in detail above with reference to the embodiments, the present disclosure is not limited thereto. It is apparent by those skilled in the art that various modifications and alterations may be made without departing from the technical spirit of the present disclosure, the modifications and alterations belong to the scope of claims, and the technical spirit also belongs to the present disclosure.

The invention claimed is:

1. A boiler for making hot water and room heating water available simultaneously, the boiler comprising:

a heat exchanger;

a water tank positioned adjacent to the heat exchanger, and having a cylindrical shape having a vacant space inside the cylindrical shape;

a casing configured to cover the heat exchanger and the water tank;

a first connection pipe configured to connect an upper side of the heat exchanger and an upper side of the water tank;

a second connection pipe configured to connect a lower side of the heat exchanger and a lower side of the water tank;

a coil pipe positioned in the water tank;

an air vent pipe coupled with and straightly protruding upward from a top surface of the water tank, and having an on-off valve at an upper portion of the air vent pipe, wherein the on-off valve is configured to open or close the air vent pipe;

a room heating water connection pipe having a first distal end coupled with a side of a lower portion of the air vent pipe and a second distal end coupled with an inlet of a room heating pipe, wherein the room heating water connection pipe is configured to transmit the room heating water supplied from the water tank, to the inlet of the room heating pipe;

a returning water connection pipe configured to connect an outlet of the room heating pipe and the water tank;

a direct water connection pipe protruding upward from the top surface of the water tank, and configured to connect a direct water pipe and a first end of the coil pipe;

a hot water connection pipe protruding upward from the top surface of the water tank, and configured to connect a second end of the coil pipe and a hot water pipe, and a hot returning water connection pipe having a first distal end coupled with a side portion of the direct water connection pipe and a second distal end coupled with an outlet of the hot water pipe, wherein except for the second distal end, the hot returning water connection pipe is positioned within the casing of the boiler, characterized in that air in the water tank flows in an upward direction from the top surface of the water tank along the air vent pipe, while the heating water flows in an upward direction from the top surface of the water tank along the air vent pipe and then changes direction to flow into the room heating water connection pipe at the lower portion of the air vent pipe where the room heating water connection pipe is coupled with, and the lower portion of the air vent pipe is positioned closer to the top surface of the water tank than to the on-off valve, wherein a first distal end of the returning water connection pipe is connected to the outlet of the room heating pipe, and a second distal end of the returning water connection pipe is connected to the lower side of the water tank.

2. The boiler of claim 1, wherein a first distal end of the direct water connection pipe is connected to the direct water pipe, and a second distal end of the direct water connection pipe penetrates the top surface of the water tank and is connected to the first end of the coil pipe, and wherein a first distal end of the hot water connection pipe is connected to an inlet of the hot water pipe, and a second distal end of the hot water connection pipe penetrates the top surface of the water tank and is connected to the second end of the coil pipe.

3. The boiler of claim 1, wherein the coil pipe comprises:

a first coil tube having a first coil shape, and positioned in the vacant space, along a longitudinal direction of the cylindrical shape of the water tank;

a second coil tube having a second coil shape, and positioned in the vacant space and inside the first coil tube, along the longitudinal direction of the cylindrical shape of the water tank, wherein the water flows in a downward direction in the first coil and an upward direction in the second coil; and a connection tube configured to connect a lower side of the first coil tube and a lower side of the second coil tube, and wherein the direct water connection pipe is connected to the first coil tube, and the hot water connection pipe is connected to the second coil tube.

4. The boiler of claim 1, wherein the casing integrally covers the heat exchanger, the water tank, the first connection pipe, and the second connection pipe.

* * * * *